US005557194A

United States Patent [19]

Kato

[11] Patent Number: 5,557,194

[45] Date of Patent: Sep. 17, 1996

[54] REFERENCE CURRENT GENERATOR

[75] Inventor: Hatsuhiro Kato, Hakodate, Japan

[73] Assignee: Kabushiki Kaisha Toshiba, Kawasaki, Japan

[21] Appl. No.: 359,460

[22] Filed: Dec. 20, 1994

[30] Foreign Application Priority Data

Dec. 27, 1993 [JP] Japan ..... 5-329482

[51] Int. Cl.[6] ..... G05F 3/16

[52] U.S. Cl. ..... 323/315; 327/542

[58] Field of Search ..... 323/312, 315, 323/317; 327/530, 538, 542

[56] References Cited

U.S. PATENT DOCUMENTS 4,442,398 4/1984 Bertails et al. ..... 323/315
4,563,632 1/1986 Palara et al. ..... 323/316
5,173,656 12/1992 Seevinck et al. ..... 323/314
5,436,552 7/1995 Kajimoto ..... 323/313

*Primary Examiner*—Peter S. Wong
*Assistant Examiner*—Adolf Berhane
*Attorney, Agent, or Firm*—Foley & Lardner

[57] ABSTRACT

A reference current generator has a bipolar transistor Q1 having an emitter connected to a low-potential power source through a resistor R1, a bipolar transistor Q2 having a collector connected to the collector of the bipolar transistor Q1 and an emitter connected to the low-potential power source, and a bipolar transistor Q3 having a base connected to the bases of the transistors Q1 and Q2, an emitter connected to the low-potential power source, and a collector connected to a constant current source Io having negative temperature coefficient. The reference current generator provides a reference current Iref as the sum of a collector current of the bipolar transistor Q1 and a collector current of the bipolar transistor Q2. The reference current Iref may have a compensated, positive, or negative temperature coefficient as required.

11 Claims, 2 Drawing Sheets

REFERENCE CURRENT GENERATOR

BACKGROUND OF THE INVENTION

1. Field of the Invention

The present invention relates to a reference current generator capable of freely setting the temperature characteristic of a reference current to generate.

2. Description of the Prior Art

FIG. 1 shows a reference current generator according to a prior art. The reference current generator has a transistor Q51 whose collector current is provided as a reference current Iref. The reference current Iref is determined by a base-emitter voltage Vf of a transistor Q52 and the resistance of a resistor R11. One end of the resistor R11 is connected to the emitter of the transistor Q51 as well as to the base of the transistor Q52, and the other end of the resistor R11 is connected to a low-potential power source. When the temperature rises, the base-emitter voltage Vf of the transistor Q52 drops to decrease a current passing through the resistor R11, thereby reducing the reference current Iref. Namely, the reference current Iref has a negative temperature coefficient.

FIG. 2 shows a reference current generator according to another prior art. Transistors Q53, Q54, Q55, Q56, and Q57 form a current mirror circuit, and a reference current Iref is provided as a collector current of the transistor Q57. Namely, the reference current Iref is a current passing through a resistor R12 connected to the emitter of the transistor Q57. The reference current Iref is expressed as follows:

$$Iref=(Vf56-Vf57)/R \quad (1)$$

where Vf56 is a base-emitter voltage of the transistor Q56, Vf57 is a base- emitter voltage of the transistor Q57, and R is the resistance of the resistor R12.

When the size of the emitter of the transistor Q57 is larger than that of the transistor Q56, a decrease in the base-emitter voltage Vf57 due to an increase in the temperature is larger than that in the base-emitter voltage Vf56. Accordingly, the reference current Iref expressed with the equation (1) has a positive temperature coefficient, and therefore, is increased when the temperature rises.

In this way, the reference current provided by the conventional reference current generators has a positive or negative temperature coefficient, and these conventional generators have no measures to compensate fluctuations in the reference current due to changes in the temperature. These reference current generators frequently cause malfunctions in, for example, a sense amplifier that is sensitive to a slight fluctuation in the reference current.

The conventional reference current generators have a positive or negative temperature coefficient, which is not selectable according to requirements.

SUMMARY OF THE INVENTION

An object of the present invention is to provide a reference current generator capable of compensating or optionally setting the temperature characteristic of a reference current to generate.

In order to accomplish the object, a first aspect of the present invention provides a reference current generator of FIG. 3. The reference current generator has a first transistor Q1 having an emitter connected to a first power source through a resistor R1, a second transistor Q2 having a collector connected to the collector of the first transistor Q1, an emitter connected to the first power source, and a base connected to the base of the first transistor Q1, and a third transistor Q3 having a base connected to the base of the first transistor Q1, an emitter connected to the first power source, and a collector connected to the base of its own as well as to a constant current source Io. A current Ioo from the constant current source Io falls as the temperature rises. This reference current generator provides a reference current Iref as the sum of a collector current I1 of the first transistor Q1 and a collector current I2 of the second transistor Q2.

A second aspect of the present invention provides a reference current generator of FIG. 7. The reference current generator has a constant current source, which consists of a fourth transistor Q6 having a collector connected to a second power source and an emitter connected to the collector of a third transistor Q3 through a second resistor R4, a first FET (field effect transistor) M3 having a source connected to the second power source and a drain connected to the base of the fourth transistor Q6, a diode group D1 arranged between the base of the fourth transistor Q6 and a first power source, a capacitor C1 arranged between the base of the fourth transistor Q6 and the first power source, and a second FET M4 having a source connected to the second power source, a drain connected to the collector of a first transistor Q1, and a gate connected to the drain of its own as well as to the gate of the first FET M3.

This reference current generator provides a reference current Iref as the sum of a first reference current I1 having a positive temperature coefficient and a second reference current I2 having a negative temperature coefficient. The temperature characteristics and quantities of the first and second reference currents I1 and I2 are adjustable to provide the reference current Iref with a compensated, positive, or negative temperature coefficient as required.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the invention in practice.

DETAILED DESCRIPTION OF THE EMBODIMENTS

Figure 1:
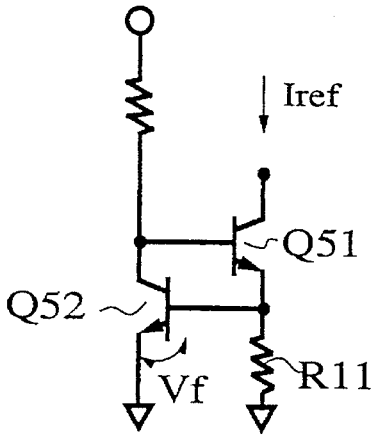
FIG. 1 shows a reference current generator according to a prior art.
Figure 2:
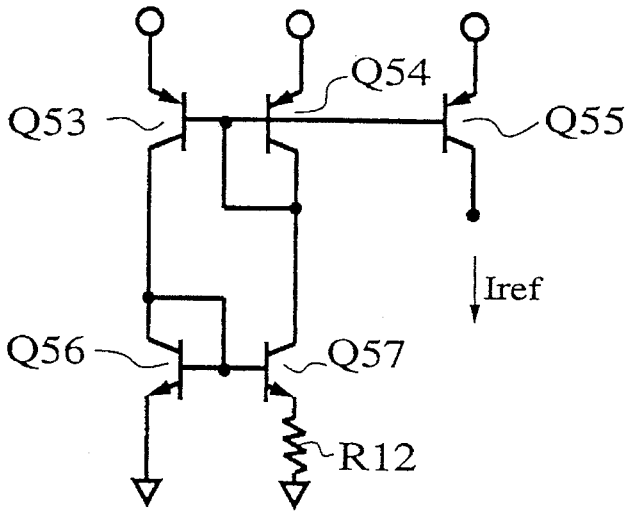
FIG. 2 shows a reference current generator according to another prior art.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Figure 3:
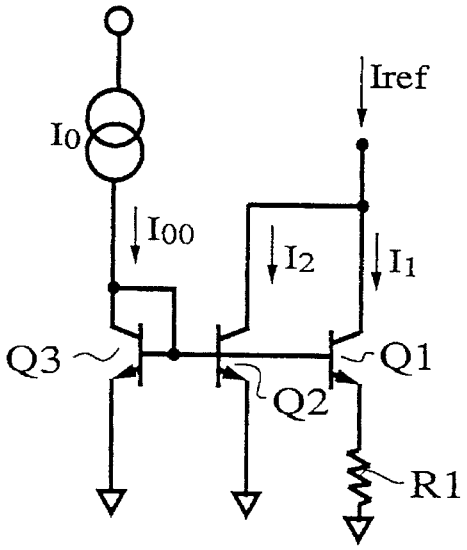
FIG. 3 shows a reference current generator according to a first embodiment of the present invention.

FIG. 3 shows a reference current generator according to the first embodiment of the present invention. The reference current generator has a bipolar transistor Q1 having an emitter connected to a low-potential power source through a resistor R1, a bipolar transistor Q2 having a collector connected to the collector of the bipolar transistor Q1 and an emitter connected to the low-potential power source, and a bipolar transistor Q3 having a base connected to the bases of the bipolar transistors Q1 and Q2, an emitter connected to the low-potential power source, and a collector connected to a constant current source Io as well as to the base of its own. This reference current generator provides a reference current Iref as the sum of a collector current I1 of the bipolar transistor Q1 and a collector current I2 of the bipolar transistor Q2.

The collector current I1 of the bipolar transistor Q1 is expressed as follows:

$$I1=(Vf3-Vf1)/R1 \quad (2)$$

where Vf1 is a base-emitter voltage of the bipolar transistor Q1, Vf3 is a base-emitter voltage of the bipolar transistor Q3, and R1 is the resistance of the resistor R1.

If the size of tile emitter of the bipolar transistor Q1 is larger than that of the bipolar transistor Q3 and if the resistance R1 is adjusted to equalize the collector current I1 of the bipolar transistor Q1 to a collector current I3 of the bipolar transistor Q3, a decrease ΔVf3 in the base-emitter voltage Vf3 of the bipolar transistor Q3 due to an increase in the temperature will be smaller than a decrease ΔVf1 in the base-emitter voltage Vf1 of the bipolar transistor Q1 due to the same temperature increase. Accordingly, the collector current I1 of the bipolar transistor Q1 has a positive temperature coefficient.

On the other hand, the collector current I2 of the bipolar transistor Q2 has the same temperature characteristic as the constant current source Io because the collector current I2 is produced by a current mirror circuit consisting of the bipolar transistors Q2 and Q3. Consequently, the collector current I2 of the bipolar transistor Q2 has a negative temperature coefficient if an output current Ioo of the constant current source Io has a negative temperature characteristic. The reference current Iref (=I1+I2) will not be influenced by changes in the temperature if the collector current I1 of the bipolar transistor Q1 having the positive temperature coefficient and the collector current I2 of the bipolar transistor Q2 having the negative temperature coefficient are set to cancel fluctuations caused in the collector currents due to the temperature changes. Namely, fluctuations in the collector currents I1 and I2 due to changes in the temperature are compensated with each other. The reference current Iref may have a positive or negative temperature coefficient by adjusting the collector currents I1 and I2 of the bipolar transistors Q1 and Q2 such that one fluctuates greater than the other in response to a change in the temperature. If the size of the emitter of the bipolar transistor Q1 is smaller than that of the bipolar transistor Q3, the collector current I1 of the bipolar transistor Q1 will have a negative temperature coefficient according to the equation (2). The same effects mentioned above are also provided when the constant current source Io has a positive temperature coefficient and the collector current I1 has a negative temperature coefficient.

Figure 4:
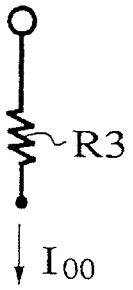
FIG. 4 shows a constant current source of the reference current generator of FIG. 3.

FIG. 4 shows an example of the constant current source Io of the reference current generator of the first embodiment of FIG. 3. The constant current source Io consists of a resistor R3. One end of the resistor R3 is connected to a high-potential power source and the other end provides a constant current to the collector of the bipolar transistor Q3 of FIG. 3. The resistor R3 is made from semiconductor material such as polysilicon or monocrystalline silicon, so that the resistance of the resistor R3 makes nonlinear changes in response to temperature changes. Namely, at extremely low temperature below 20 K. the resistance of semiconductor material decreases according to temperatures and increases according to temperatures over a predetermined temperature. The constant current source Io may have a positive or negative temperature characteristic by selecting a temperature range of use. Practically, the temperature coefficient of the resistivity of semiconductor material is positive at room temperature. If the resistor R3 is made from polysilicon, the constant current source Io has a slightly negative temperature characteristic at room temperature (300 K.). Accordingly, the reference current generator of FIG. 3 may have a compensated, positive, or negative temperature coefficient as required.

Figure 5:
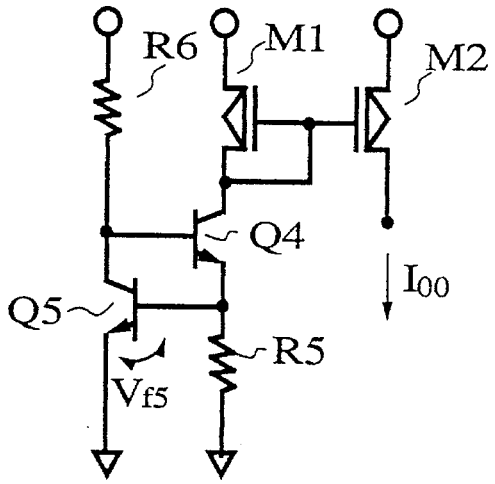
FIG. 5 shows a constant current source applicable to the reference current generator of FIG. 3, according to a second embodiment of the present invention.

FIG. 5 shows a constant current source Io applicable to the reference current generator of FIG. 3, according to the second embodiment of the present invention. A common gate terminal of a pair of p-channel FETs M1 and M2 is connected to a reference current generator that is identical to the prior art of FIG. 1. A drain current of the FET M2 serves as a constant current Ioo. The constant current Ioo is expressed as follows:

$$Ioo=Vf5/R5$$

where Vf5 is a base-emitter voltage of a bipolar transistor Q5 and R5 is the resistance of a resistor RS. When an increase in the temperature of the resistor RS is suppressed, the constant current Ioo has a negative temperature coefficient similar to the base-emitter voltage Vf5 of the bipolar transistor Q5.

Figure 6:
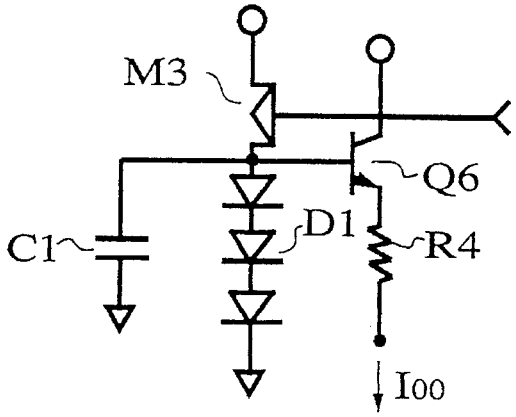
FIG. 6 shows a constant current source applicable to the reference current generator of FIG. 3, according to a third embodiment of the present invention.

FIG. 6 shows another constant current source Io applicable to the reference current generator of FIG. 3, according to the third embodiment of the present invention. The constant current source Io has a bipolar transistor Q6 having a collector connected to the high-potential power source and an emitter connected to a resistor R4, a p-channel FET M3 arranged between the high-potential power source and the base of the bipolar transistor Q6 and to be turned ON and OFF in response to a gate signal, and a diode group D1 and a capacitor C1 arranged between the base of the bipolar transistor Q6 and the low-potential power source. The other end of the resistor R4 provides a constant current Ioo. This end of the resistor R4 is connected to the collector of the bipolar transistor Q3 as well as to the base of the bipolar transistor Q2 as shown in FIG. 3. The constant current Ioo flowing to the bipolar transistor Q3 is expressed as follows:

$$Ioo=(3VfD-Vf6-Vf3)/R4 \quad (3)$$

where VfD is a forward voltage of each diode in the diode group D1, which includes three diodes in this example, Vf3 is a base-emitter voltage of the bipolar transistor Q3, Vf6 is a base-emitter voltage of the bipolar transistor Q6, and R4 is the resistance of the resistor R4.

The constant current Ioo has a negative temperature coefficient due to the forward voltage VfD of each diode. Accordingly, the collector current I2 of the bipolar transistor Q2 of the current mirror circuit has a negative temperature coefficient. The reference current Iref will not be influenced by changes in the temperature, if the collector current I1 of the bipolar transistor Q1 having a positive temperature coefficient and the collector current I2 of the bipolar transistor Q2 having a negative temperature coefficient are set to cancel fluctuations caused in the collector currents due to the temperature changes. The reference current Iref may have a positive or negative temperature characteristic by adjusting the collector currents I1 and I2 of the bipolar transistors Q1 and Q2 such that one fluctuates greater than the other due to a change in the temperature.

Figure 7:
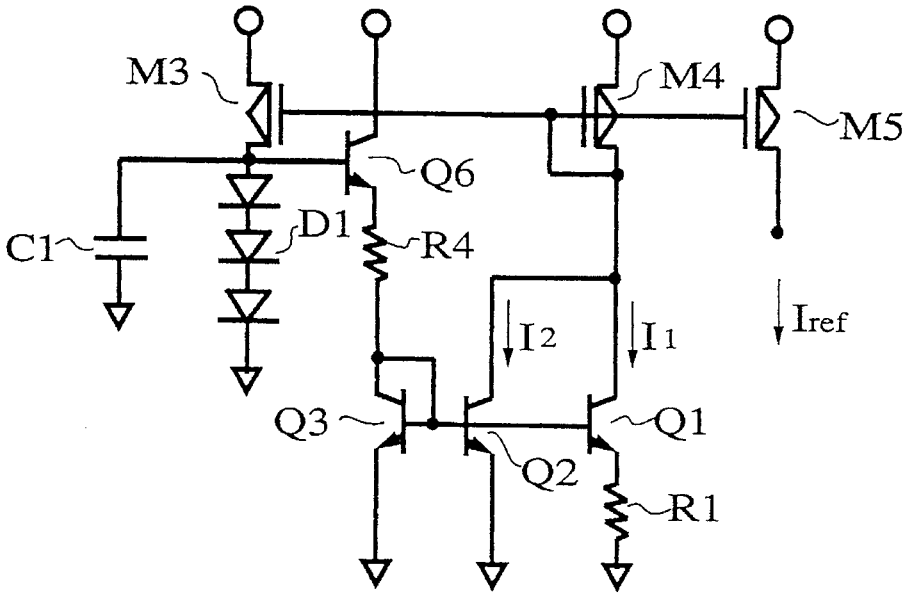
FIG. 7 shows a reference current source generator according to a fourth embodiment of the present invention.

FIG. 7 shows a reference current generator according to the fourth embodiment of the present invention, which is a combination of the circuits of FIGS. 3 and 6. The gates of FETs M4 and M5 are connected to the gate of a FET M3 of a constant current source Io. The gate of the FET M4 is connected to the drain of its own as well as to the collectors of bipolar transistors Q1 and Q2. The drain of the FET M5 provides a reference current Iref as the sum of a collector current I1 of the bipolar transistor Q1 and a collector current I2 of the bipolar transistor A constant current Ioo flowing to a bipolar transistor Q3 is expressed as follows:

$$Ioo=(mVfD-Vf6-Vf3)/R4 \quad (4)$$

where VfD is a forward voltage of each diode of a diode group D1, which includes m diodes in this example, Vf3 is a base-emitter voltage of the bipolar transistor Q3, Vf6 is a base-emitter voltage of a bipolar transistor Q6, and R4 is the resistance of a resistor R4.

The constant current Ioo has a negative temperature coefficient due to the forward voltage VfD of each diode. In FIG. 7, m=3. The constant current Ioo may have a required temperature characteristic by optionally setting the forward voltage VfD of each diode relative to the base-emitter voltages of the bipolar transistors Q3 and Q6, and the number of diodes in the diode group D1. Although the diodes are connected in series in FIG. 7, they may be connected in parallel, or partly in series and partly in parallel, to adjust the constant current Ioo. The reference current Iref will not be influenced by changes in the temperature, if the collector current I1 of the bipolar transistor Q1 having a positive temperature coefficient and the collector current I2 of the bipolar transistor Q2 having a negative temperature coefficient are set to cancel fluctuations caused in the collector currents due to the temperature changes. Alternatively, the reference current Iref may have a positive or negative temperature characteristic by adjusting the collector currents I1 and I2 of the bipolar transistors Q1 and Q2 such that one fluctuates greater than the other due to a change in the temperature.

Various modifications will become possible for those skilled in the art after receiving the teachings of the present disclosure without departing from the scope thereof.

What is claimed is:

1. A reference current generator comprising:

(a) a first bipolar transistor (Q1) having an emitter connected to a first power source through a first resistor (R1);

(b) a second bipolar transistor (Q2) having a collector connected to the collector of said first bipolar transistor (Q1), an emitter connected to the first power source, and a base connected to the base of said first bipolar transistor (Q1);

(c) a constant current source (Io) having a negative temperature coefficient, provided with a terminal connected to a second power source and another terminal serving as an output terminal; and (d) a third bipolar transistor (Q3) having a base connected to the bases of said first and second bipolar transistors (Q1, Q2), an emitter connected to the first power source, and a collector connected to its own base and to the output terminal of said constant current source, wherein said second and third bipolar transistors (Q2, Q3) constitute a current mirror circuit, and wherein the reference current generator provides a reference current as the sum of a first collector current of said first bipolar transistor and a second collector current of said second bipolar transistor, said first collector current having a positive temperature coefficient and said second collector current having a negative temperature coefficient so that fluctuations in said first and second collector currents due to temperature changes are compensated in order to generate a constant reference current.

2. The reference current generator as claimed in claim 1, wherein the size of the emitter of said first bipolar transistor (Q1) differs from that of said third bipolar transistor (Q3).

3. The reference current generator as claimed in claim 1, wherein said constant current source (Io) is a semiconductor resistor.

4. A reference current generator comprising:

(A) a first transistor (Q1) having an emitter connected to a first power source through a first resistor (R1);

(B) a second transistor (Q2) having a collector connected to the collector of said first transistor (Q1), an emitter connected to the first power source, and a base connected to the base of said first transistor (Q1);

(C) a third transistor (Q3) having a base connected to the bases of said first and second transistors (Q1, Q2), an emitter connected to the first power source, and a collector connected to its own base; and (D) a constant current source (Io) having a negative temperature coefficient, the constant current source including (a) a first FET (field effect transistor) (M1) having a source connected to a second power source and a gate connected to its own drain;

(b) a second FET (M2) having a source connected to the second power source, a drain connected to said third transistor (Q3), and a gate connected to the gate of the first FET (M1);

(c) a fourth transistor (Q4) having a collector connected to the drain of the first FET and an emitter connected to the first power source through a second resistor (R5); and (d) a fifth transistor (Q5) having a collector connected to the base of the fourth transistor as well as to the second power source through a third resistor (R6), an emitter connected to the first power source, and a base connected to the emitter of the fourth transistor, wherein the reference current generator provides a reference current as the sum of a collector current of said first transistor and a collector current of said second transistor.

5. A reference current generator comprising:

(A) a first transistor (Q1) having an emitter connected to a first power source through a first resistor (R1);

(B) a second transistor (Q2) having a collector connected to the collector of said first transistor (Q1), an emitter connected to the first power source, and a base connected to the base of said first transistor (Q1);

(C) a third transistor (Q3) having a base connected to the bases of said first and second transistors (Q1, Q2), an emitter connected to the first power source, and a collector connected to its own base; and (D) a constant current source (Io) having a negative temperature coefficient, the constant current source including (a) a fourth transistor (Q6) having a collector connected to a second power source and an emitter connected to the collector of said third transistor through a second resistor (R4);

(b) a first FET (field effect transistor) (M3) having a source connected to the second power source and a drain connected to the base of the fourth transistor (Q6);

(c) at least one diode (D1) arranged between the base of the fourth transistor (Q6) and the first power source; and (d) a capacitor (C1) arranged between the base of the fourth transistor (Q6) and the first power source, wherein the reference current generator provides a reference current as the sum of a collector current of said first transistor and a collector current of said second transistor.

6. The reference current generator as claimed in claim 5, further comprising a second FET (M4) having a source connected to the second power source, a drain connected to the collector of said first transistor (Q1), and a gate connected to the drain of its own as well as to the gate of the first FET (M3).

7. The reference current generator as claimed in claim 5, in which the diodes are connected in series.

8. The reference current generator as claimed in claim 5, in which the diodes are partly connected in parallel.

9. The reference current generator as claimed in claim 6, in which the diodes are connected in series.

10. A reference current generator comprising:

(a) a first transistor (Q1) having an emitter connected to a first power source through a first resistor (R1);

(b) a second transistor (Q2) having a collector connected to the collector of said first transistor (Q1), an emitter connected to the first power source, and a base connected to the base of said first transistor;

(c) a third transistor (Q8) having a base connected to the bases of said first and second transistors, an emitter connected to the first power source, and a collector connected to the base of its own;

(d) a fourth transistor (Q6) having a collector connected to a second power source and an emitter connected to the collector of said third transistor (Q3) through a second resistor (R4);

(e) a first FET (Field effect transistor) (MS) having a source connected to the second power source and a drain connected to the base of said fourth transistor (Q6);

(f) at least one diode (D1) arranged between the base of said fourth transistor (Q6) and the first power source;

(g) a capacitor (C1) arranged between the base of said fourth transistor (Q6) and the first power source;

(h) a second FET (M4) having a source connected to the second power source, a drain connected to the collector of said first transistor (Q1), and a gate connected to the drain of its own as well as to the gate of said first FET (M3); and (i) a third FET (M5) having a source connected to the second power source, a gate connected to the gates of said first and second FETs (M3, M4), and a drain providing a reference current.

11. The reference current generator as claimed in claim 7, in which the diodes are connected in series.

* * * * *